US012473003B2

(12) United States Patent
Strub et al.

(10) Patent No.: US 12,473,003 B2
(45) Date of Patent: Nov. 18, 2025

(54) TRAFFIC NETWORK AND METHOD FOR OPERATING RAIL VEHICLES IN A TRAFFIC NETWORK

(71) Applicant: Siemens Mobility GmbH, Munich (DE)

(72) Inventors: Leo Strub, Braunschweig (DE); Carlsson Scholl, Teltow (DE)

(73) Assignee: Siemens Mobility GmbH, Munich (DE)

( * ) Notice: Subject to any disclaimer, the term of this patent is extended or adjusted under 35 U.S.C. 154(b) by 100 days.

(21) Appl. No.: 18/458,344

(22) Filed: Aug. 30, 2023

(65) Prior Publication Data

US 2024/0067244 A1 Feb. 29, 2024

(30) Foreign Application Priority Data

Aug. 30, 2022 (EP) ..... 22192950

(51) Int. Cl.
*B61L 27/70* (2022.01)

(52) U.S. Cl.
CPC ..... *B61L 27/70* (2022.01)

(58) Field of Classification Search
CPC ..... B61L 27/70; B61L 27/37; B61L 27/10; B61L 27/20; B61L 27/50; B61L 2027/204; B61L 15/0027
USPC ..... 701/19, 20
See application file for complete search history.

(56) References Cited

FOREIGN PATENT DOCUMENTS

KR 1262036 B1 * 5/2013 ..... B61L 23/14
KR 101262036 B1 5/2013

OTHER PUBLICATIONS

"Urban rail ITS and Road ITS applications in the 5,9 GHz band; Investigations for the shared use of spectrum", ETSI Draft Specification; 103 580, European Telecommunications Standards Institute (ETSI), 650, Route Des Lucioles; F-06921 Sophia-Antipolis; France, Bd. WG RT JTFIR Joint Task Force ITS RT, Nr. V0.0.18 May 9, 2019 (May 9, 2019), pp. 1-69, XP014343543, Gefunden im Internet: URL:docbox.etsi.org/RT/RTJTFIR/70-Draft/JTFIR88/RT-JTFIR-2v0018.docx.

* cited by examiner

*Primary Examiner* — Hai H Huynh
(74) *Attorney, Agent, or Firm* — Laurence A. Greenberg; Werner H. Stemer; Ralph E. Locher

(57) ABSTRACT

A method for operating rail vehicles in an operational area of a traffic network that is shared with traffic participants other than the rail vehicles. The rail vehicles communicate with line elements arranged in the operational area. Here, the rail vehicles and the line elements use a V2X standard for communication between each other within the shared operational area. In an operational area that is reserved for the rail vehicles, the rail vehicles communicate with the line elements via a communication standard that is different from the V2X standard.

17 Claims, 2 Drawing Sheets

TRAFFIC NETWORK AND METHOD FOR OPERATING RAIL VEHICLES IN A TRAFFIC NETWORK

CROSS-REFERENCE TO RELATED APPLICATION

This application claims the priority, under 35 U.S.C. § 119, of European Patent Application EP 22192950.8, filed Aug. 30, 2023; the prior application is herewith incorporated by reference in its entirety.

FIELD AND BACKGROUND OF THE INVENTION

The invention relates to a method for operating rail vehicles in a traffic network. In addition, the invention relates to a method for modernizing an operational area for rail vehicles. Furthermore, the invention relates to a traffic network for operating rail vehicles with an operational area shared with traffic participants other than the rail vehicles. Furthermore, the invention relates to a rail vehicle for operation in a traffic network having an operational area shared with traffic participants other than the rail vehicles and to a processing unit for operation in a traffic network having an operational area shared with traffic participants other than the rail vehicles. Finally, the invention relates to a computer program and to a provision apparatus for this computer program, wherein the computer program is equipped with program commands for carrying out this method.

By way of example, CBTC (Communication-Based Train Control) is used in train protection operation (in an operational area reserved for rail vehicles) of streetcars that travel underground. There, a computer-assisted method supported by bidirectional communication is therefore carried out for central train monitoring and operational management with the sub-functions of automatic train protection, automatic handling and automatic monitoring. In running on sight operation without automatic train protection (i.e., in an operational area shared with other traffic), as a rule, intermittent unidirectional communication (for example with IMU coupling coils, IMU stands for inductive message transmission) takes place between train and line. The areas are treated separately on implementation. Exact train tracking in operational areas shared with other traffic is therefore not possible for the operator with running on sight operation. Operational areas reserved solely for rail vehicles are represented on the control and protection system. In the cockpit of the train there is an HMI for the reserved operational area with automatic train protection (train protection operation).

For example, a train stop in the shared operational area is customarily implemented by line equipment in the track (inductive, magnetic or mechanical transmission principles, such as coupling coils, Eurobalise or the like), which sends the information about a clearance to travel (corresponds to inactive train stop) or stop (corresponds to activated train stop) to a corresponding antenna when the line equipment is passed by being crossed. The vehicle equipment triggers a braking operation when a "stop" is received.

Continuous monitoring operations are often used in metro and long-distance rail systems to prevent the danger points being crossed, such as in the case of ETCS (European Train Control System), PTC (Positive Train Control) and CBTC (Communication-Based Train Control). Continuous monitoring permits automatic train running control by applying a continuous train running operation and makes the installation of a lot of line-side equipment superfluous, although the continuous monitoring system is significantly more complex elsewhere. Continuous monitoring operations, for example CBTC, are carried out in the case of streetcars which travel partially underground or pass through relatively long tunnels. Owing to the more complex traffic situation (traffic participants such as cars, bicycles and pedestrians have to be taken into account) in above-ground train operation, the journey of the train has to be carried out by a vehicle driver (running on sight operation), however. Here, line-side equipment is relied upon, such as coupling coils which are fitted on the track in the road and corresponding components for communication in the vehicle.

The components of the running-on-sight operation require a certain amount of installation space. In particular in the case of so-called low-floor vehicles (for example streetcars), in which the space between the vehicle floor and the track is limited, problems of space occur in the installation of said components. In addition, the components require a certain maintenance effort to prevent disruptions. In particular, components fitted in the track in the case of streetcars are crossed not only by the streetcar but also by other vehicles which use the road. This brings about increased mechanical stress on the components, which also increases their susceptibility to failure.

SUMMARY OF THE INVENTION

It is accordingly an object of the invention to provide a traffic network and a corresponding method which overcome a variety of disadvantages of the heretofore-known devices and methods of this general type and which provides for a method, a traffic network (containing routes comprising railroads) for operating rail vehicles, and a rail vehicle, which with optimally low expenditure on components fitted, in particular, on or in the track, guarantees an optimally large range of functions in a traffic area shared with other traffic participants. In addition, it is a further object of the invention to disclose a computer program and a provision apparatus for the computer program with which the method can be carried out.

With the above and other objects in view there is provided, in accordance with the invention, a method for operating a rail vehicle in a traffic network which has a shared operational area that is shared with traffic participants other than the rail vehicle and an operational area that is exclusive to the rail vehicles. The method comprises:

communicating between the rail vehicle and line elements arranged in the shared operational area by using a V2X standard for communication; and communicating between the rail vehicle and line elements arranged in an operational area reserved for rail vehicles by using a communication standard different from the V2X standard for communication.

In other words, the objects of the invention are achieved in that the rail vehicles and the line elements use a V2X standard for communication between each other in a shared operational area, while in an operational area that is reserved for the rail vehicles, the rail vehicles communicate with the line elements via a communication standard that is different from the V2X standard (V2X=Vehicle-to-Everything).

Use of the V2X standard advantageously enables bidirectional, continuous train-line communication, bidirectional communication is also possible with the communication standard (for example CBTC) different from the V2X standard. V2X is based, moreover, on radio-based transmission. For this reason no hardware is required in the track. All components are easily accessible and the infrastructure of the operator can be adapted without construction measures. In particular, infrastructure elements can also be used, which have already been installed in the catchment area of the line for communication with traffic participants, which are not rail vehicles, for example motor vehicles or buses.

V2X (Vehicle-to-Everything) as a public standard is used in the automotive industry and for this reason is future-proof and non-proprietary. V2X offers, firstly, a direct connection (WLAN technology 802.11p) between line elements and rail vehicle. The customer is therefore not dependent on the availability of public networks. V2X alternatively offers, as Cellular V2X, a mobile data link, where comfort functions (value-added services) may be implemented, which are not directly operation-critical. The value-added services can then be easily implemented by network-based communication.

One particular advantage is the migration capability with an approximately identical mode of operation to conventional message transmission technology (IMU, infrared, analog radio). Inventively, individual transmission entities can therefore be migrated independently of each other, hence also successively. Communication with components of the road infrastructure is possible in this connection. Here, it is possible to easily incorporate the, to some extent, existing infrastructure of towns (for example on traffic lights) since a uniform communication standard is used. An installed V2X roadside unit (Access Point on the line, which is not necessarily used solely by the train, but also by traffic participants other than rail vehicles) then receives messages in the ITS-G5 (V2X) format.

In running on-sight operation, the solution economizes on both the line equipment in the track and the corresponding vehicle antenna, which have to be used with conventional intermittent train running control. This results in considerable savings and solves problems with the assembly of the vehicle antennas in particular in low-floor streetcars. Instead, the V2X standard is inventively used to transmit data which relates to the implemented applications. A range of components (for the V2X standard) adapted to the modified range of functions of running on sight operation can be installed on the line, or an infrastructure for V2X already installed in the shared operational area can be used. Installation costs can be reduced hereby, at least to the extent that the components already installed allow. Because a data communication system, for example V2X, of the vehicle is used for this, the solution can be implemented comparatively inexpensively. Since train protection operation is dispensed with, COTS components, for example, can be used (COTS are Components off-the-shelf, i.e., commercially obtainable and thereby easily available and inexpensive components).

The system based on V2X thereby inventively provides digital, compact functions that are easy to implement, in particular also for streetcar systems, without trackside equipment and antennas that are tailormade for them in the rail vehicle. The digital or virtual functions can therefore preferably also be used in low-floor vehicles with limited space available (for example streetcars).

A brief summary of further advantages shall be listed below.

- Continuous capturing and reporting of the vehicle position to enable train tracking in virtual real time as an additional feature.
- Bi-directional data exchange between line and train. Advantageously, this can be guaranteed by a transmission technology, which is predefined in the reserved operational area by an automatic train protection system, whereby a change of system in bidirectional communication in the reserved operational area and in the shared operational area is avoided.
- Bidirectional communication to enable messages (text/speech) from dispatcher to drivers, and vice versa. Advantageously, this is also guaranteed by the V2X standard.
- Simplification and unification of interfaces for line infrastructure and on the vehicle. This means that, at the latest after a complete replacement of existing, generally unidirectional transmission techniques fitted in the track, it is possible to rely completely on a standardized transmission technology, which is then used in the reserved operational area as well as in the shared operational area.
- End-to-end integration of the different areas in one joint traffic management system is implemented especially in transport networks, which have both shared and also reserved operational areas, so that there is overall visibility and (albeit limited in the shared operational area) the possibility of controlling the trains throughout the entire traffic network (that is to say, in shared operational areas just like in reserved operational areas).
- The possibility of incorporating, for example, a streetcar in an overall, standardized traffic management system of a town/municipality/metropolitan area is possible. This can go beyond the rail-bound traffic and also comprise the road transport systems, for example light signal systems or omnibus lines.
- Use of all of the infrastructure equipment of an automatic train control system in the shared operational area would not be economical and would not be necessary. An operator would want needs-based, investment-optimized equipping of the line network according to the requirements profile (train protection operation vs. running on sight operation). An embodiment of the invention come into play here, according to which a modified range of functions is made available for the sight area. This is preferably reduced by safety-relevant functions, which have to be adopted by a train driver in running on sight operation. For this reason, an infrastructure which is reduced in its range of functions can also be installed in running on sight operation. For example, sensors which would be necessary for automatic driving operation can be omitted.
- Optimally little hardware in the track/track body in order to reduce maintenance and servicing expenditure and simultaneously guarantee greater flexibility in the case of changes or upgrades. This is advantageously guaranteed by the V2X standard.
- The replacement/migration of old message transmission technology since imminent obsolescence of the existing systems can be predicted. Here, the installation of an infrastructure for automatic train running control can generate synergy effects, with the infrastructure ideally providing, with standardized and future-proof technology, investment protection. This applies likewise to the hardware used. This should likewise be based as far as possible on standardized components.
- A further advantage is the upgradability. For example, it is possible to transfer the automatic train operation (train protection operation) successively also to the shared operational area if the technology is sophisticated enough for this. In this case, only the components of the infrastructure for automatic train operation still have to be installed, with retrofitting being more cost-effective in such a case than initial equipping would be. Perspectively, for example driverless streetcars can then be used in the reserved operational areas as well as in the shared operational areas.

In the context of the invention, "computer-assisted" or "computer-implemented" can be taken to mean an implementation of a method in which at least one computer or processor executes at least one method step of the method.

In connection with the invention, a "computing environment" can be taken to mean an IT infrastructure comprising components such as computers, storage and memory units, programs and data to be processed by the programs, which are used for executing at least one application, which has a task to fulfill. The IT infrastructure can also comprise, in particular, a network of said components.

Within a computing environment, a "computing instance" (or "instance" for short) can be taken to mean a functional unit, which can be associated with an application (provided, for example, by a number of program modules) and can execute this. On execution of the application this functional unit forms a physically (for example computer, processor) and/or virtually (for example program module) self-contained system.

The term "computer" covers all electronic devices with data processing properties. Computers can be, for example, clients, servers, handheld computers, communication devices and other electronic devices for data processing, which can have processors and storage units and can also be combined via interfaces to form a network.

In connection with the invention, a "processor" can be taken to mean, for example, a converter, a sensor for generating measuring signals or an electronic circuit. A processor can be, in particular, a central processing unit (CPU), a microprocessor, a microcontroller, or a digital signal processor, possibly in combination with a memory unit for storing program commands and data. A processor can also be taken to mean a virtualized processor or a soft CPU.

In connection with the invention, a "storage unit" can be taken to mean, for example, a computer-readable memory in the form of a random-access memory (RAM) or data storage device (hard drive or data carrier).

"Program modules" should be taken to mean individual software functional units, which enable an inventive program sequence of method steps. These software functional units can be realized in a single computer program or in a plurality of computer programs that communicate with each other. The interfaces implemented here can be implemented in terms of software within a single processor or in terms of hardware if a plurality of processors is used.

"Interfaces" can be implemented in terms of hardware, for example cabled or as a radio link, and/or in terms of software, for example as an interaction between individual program modules or one or more computer program(s).

According to one embodiment of the invention, it is provided that a Cooperative Awareness Message (CAM) of the V2X standard is used for communication.

In this specific application, the CAM (Cooperative Awareness Message) is used, which may alternatively also be realized with different type of message within the V2X protocol. This message advantageously contains items of information from which a desired action of a line element can be derived. This can be, for example, a course, a route and a destination from which, in the case of an individual switch controller, the switch position to be set can be ascertained.

Preferably, it is provided that an expanded (i.e., going beyond the change of specific line equipment) range of functions, which is additionally covered by the V2X standard, only contains functions which are classified as not being safety-relevant for the operation of the rail vehicle.

In accordance with international standard IEC 61508 or, specifically for the rail sector, in accordance with European standard EN 50129, four Safety Integrity Levels (SIL-1 to SIL-4) or safety requirement levels are differentiated for safety functions (safety). Here, Safety Integrity Level 4 represents the highest level and Safety Integrity Level 1 the lowest level of safety integrity. The respective Safety Integrity Level influences the confidence interval of a measured value to the extent that the confidence interval is all the smaller, the higher the Safety Integrity Level is which is to be satisfied by the respective apparatus. Restrictions result thereby owing to comparatively inaccurate measured values and the comparatively large confidence interval associated therewith, in particular for those systems which satisfy the higher Safety Integrity Level SIL-4 or SIL-3. The dimension of the safety of the different Safety Integrity Levels may be clearly described by the expected frequency of failure of the safety-relevant system, also called MTBF (Mean Time Between Failures). With SIL-1 this lies in the range of 10 . . . 100 a, with SIL-2 in the range of 100 . . . 1000 a, with SIL-3 in the range of 1,000 . . . 10,000 a, and with SIL-4 in the range of 10,000 . . . 100,000 a.

If the expanded range of functions includes only functions which are not safety-relevant then this has the advantage that the hardware infrastructure, accompanying running on sight operation, on the track itself also does not have to satisfy the requirements of increased safety. This makes use of the knowledge that in running on sight operation, the train driver is responsible for safety-relevant functions, so the automatically implemented functions themselves do not jeopardize the safety of operation of the rail vehicle.

The continuous locating of the rail vehicle in the shared operational area can be cited as an example. This is not used for safety-relevant functionalities of rail operation. In other words, the vehicle driver will make driving decisions on the basis of their own assessments and independently of the ascertained position for the vehicle in running on sight operation. Locating can be used for non-safety-relevant applications (what are known as comfort functions), however, such as an adaptive timetable. If the position ascertained by locating does not match the actual position in the case of such a function, this does not affect the safety of the rail vehicle as such but would only result in a potentially inadequately optimized timetable. The delays resulting therefrom would not constitute a safety risk for the user of the rail vehicle, however.

Advantageously, it can be provided that the expanded range of functions realizes at least one of the following functions: ascertaining items of arrival information of the rail vehicles, timetable management with an optimization of the timetable.

These functions can also have been referred to as comfort functions. Comfort functions are characterized in that they are not necessary for operation of the rail vehicle from the perspective of safety considerations. The fulfilment of comfort functions can improve the usability of the operation of the rail vehicles in the relevant traffic network, however. Improvements can lie in the efficiency of operation, for example more precise timing of successive trains in the traffic network. Or also in an improvement in utilization by the passengers, for example by predicting the actual arrival times of a rail vehicle at the station. Overall the comfort functions offered result in greater acceptance among the passengers and advantageously also in wider utilization as a result.

According to one embodiment of the invention, it is provided that the line elements, which use the V2X standard, are modified to the extent that they use a processing unit, which converts a message received according to the V2X standard into control commands for a control member or generates control commands from the received message and in both cases transmits the control commands to a controller for the relevant control member, with the controller actuating the control member using the control commands.

Within the processing unit it is accordingly calculated which action can be derived from the received items of information. For example, "The train has approached to a certain distance, it is traveling in direction A and belongs to route B, all boundary conditions are also correct." From this it is possible to derive the following: "I will give the switch controller a control command."

The item of information is now sent to the controller of the line element. The same inputs are used in this case which the previous conventional system (for example what is known as IMU91) used, and this advantageously supports a successive migration from the conventional system to the inventive system. This is because the transmission path is replaced without changing the active components. One advantage is also being able to connect controllers from other manufacturers. When changing over to a system on V2X, individual IMU loops can be replaced line-side and individual processing units installed. Since communication can take place decentrally 1:1 the consequence is a particularly easy migration capability.

According to one embodiment of the invention, it is provided that the converted control commands (control demand) have a syntax, which corresponds to that of specific line elements developed for the relevant control member.

The specific line elements are those which are to be modified or modernized by the processing unit (or have already been modified or modernized). If, after converting the messages according to the V2X standard, messages can as a result be forwarded in that syntax which the specific line elements previously used, it is advantageously possible that the controller and the control member receive the same messages as was the case before the modernization (replacement of specific line elements by processing units according to the V2X standard). This advantageously means that no software update is necessary for the controller and optionally the control member. A new registration of the controller or of the control member, which is potentially associated with a change of system, is also significantly simplified thereby.

According to one embodiment of the invention, it is provided that the modified line elements as well as the specific line elements are used in the shared operational area.

A shared operational area, which is configured such that the modified line elements as well as the specific line elements can be used, as already explained, makes the successive modernization of the shared operational area possible. This means that the specific line elements, such as contact loops in the road surface, can gradually be replaced by modified line elements, such as radio modules according to the V2X-standard (in the context of this invention, also integrated in what are known as V2X units or rail vehicles). Advantageously, operation with rail vehicles in the relevant traffic network is barely disrupted in the process, so relatively long line suspensions do not have to occur. In addition, the change of system can be carried out successively and therewith dependent on requirements and inexpensively.

According to one embodiment of the invention, it is provided that specific line elements permanently fitted in a track body are replaced.

A track body is taken to mean the entire system on which a railbound means of transport can travel, i.e., rails and their attachment, for example with railroad ties to ballast, i.e., a track bed made from broken rock, or even a road for road vehicles as a track bed, as is customary with streetcars.

According to one embodiment of the invention, it is provided that specific line elements embedded in a road surface surrounding the track are replaced.

When specific line elements, which are permanently fitted in the track body, are replaced the advantage of a change of system on the inventive modified line elements becomes particularly clear. The specific line elements can remain at the installation location, for which reason no construction work will be necessary. At the same time the modified line elements can be installed in the traffic network without major construction work. They do not require an installation location in the track body, and instead they can be provided in the vicinity of the track. Communication then advantageously takes place by way of the V2X standard via radio.

According to one embodiment of invention, it is thus provided that modified line elements fitted outside of the track body (for example in the form of V2X units) are used so the construction work associated with the installation can be reduced to a minimum, as explained.

With the above and other objects in view there is also provided, in accordance with the invention, for the purpose of modernization, line elements specific to the relevant control member and fitted in a line of the operational area are successively replaced by modified line elements, which modified line elements are configured as a processing unit, which converts a message received in accordance with the communication standard into control commands for a control member or generates control commands from the received message and in both cases transmits them to a controller for the relevant control member, wherein the controller actuates the control member using the control commands, the control commands have a syntax, which matches that of the specific line elements fitted in a line for the rail vehicle, wherein line elements designed as a processing unit as well as specific line elements are used in the shared operational area.

According to one embodiment of the invention, it is provided that a V2X standard is used as the communication standard.

According to one embodiment of the invention, it is provided that the operational area lies in a traffic network, which is shared with traffic participants other than the rail vehicles.

The advantages, which have already been explained in connection with the method described in more detail above, may be achieved by said further method. That which has been stated in relation to the inventive method also applies accordingly to the inventive further method (for modernization).

The objects of the invention are alternatively also achieved by the subject matter of the above description relating to the traffic network in that the traffic network has line elements, which are configured to carry out the novel method.

The objects of the invention are alternatively also achieved by the subject matter of the description relating to the rail vehicle in that the rail vehicle is configured to communicate with a line element in the novel method.

The objects of the invention are alternatively also achieved by the subject matter of the description relating to a processing unit in that the processing unit is configured to communicate with a line element in the novel method.

According to an advantageous embodiment of the invention the line element is a modified line element.

The advantages, which have already been explained in connection with the method described in more detail above, may be achieved by said apparatuses. That which has been stated in relation to the inventive method also applies accordingly to the inventive apparatuses.

Furthermore, a computer program containing program modules, having program commands for carrying out said inventive method and/or its exemplary embodiments, is claimed, it being possible to carry out the inventive method and/or its exemplary embodiments respectively by means of the computer program.

A provision apparatus for storing and/or providing the computer program is claimed, moreover. The provision apparatus is, for example, a storage unit, which stores and/or provides the computer program. Alternatively and/or in addition, the provision apparatus is, for example, a network service, a computer system, a server system, in particular a distributed, for example cloud-based, computer system and/or virtual computer system, which stores and/or provides the computer program preferably in the form of a data stream.

The provision takes place in the form of a program data set as a file, in particular as a download file, or as a data stream, in particular as a download data stream, of the computer program. The computer program can also be provided, for example, as a partial download, however, which comprises several parts. A computer program of this kind is read into a system, for example using the provision apparatus, so the inventive method is executed on a computer.

Further details of the invention will be described below with reference to the drawings. Identical or corresponding elements of the drawings are provided with identical reference characters respectively and will only be explained multiple times insofar as there are differences between the individual figures.

The construction and method of operation of the invention, however, together with additional objects and advantages thereof will be best understood from the following description of specific embodiments when read in connection with the accompanying drawings. It will be understood that the exemplary embodiments explained below are preferred embodiments of the invention. In the exemplary embodiments the described components of the embodiments respectively represent individual features of the invention which are to be considered independently of each other, which also develop the invention independently of each other respectively and should therewith also be regarded, individually or in a combination other than that shown, as a constituent part of the invention. Furthermore, the described components can also be combined with the features of the invention described above.

DETAILED DESCRIPTION OF THE INVENTION

Figure 1:
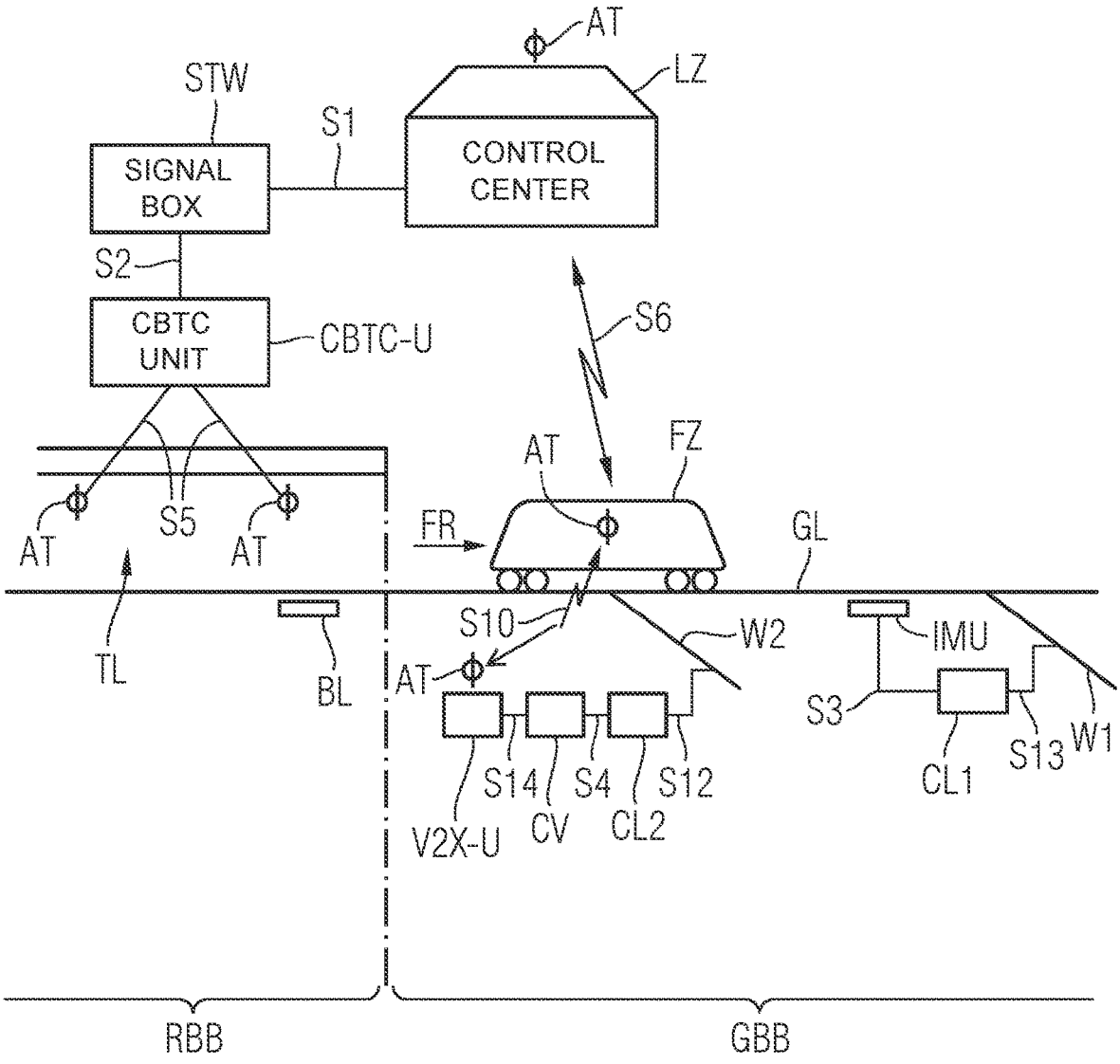
FIG. 1 is a schematic view of an exemplary embodiment of the inventive equipment in the form of the transport network and the rail vehicle with their cause-effect relationships.

Referring now to the figures of the drawing in detail and first, in particular, to FIG. 1 thereof, there is shown a traffic network, which is provided, by way of example, by a track GL of the line co-forming the traffic network for a vehicle FZ, which moves in a direction of travel FR. The line has a reserved operational area RBB where only rail vehicles FZ are allowed to run. This is the case in a tunnel TL. In addition, there is a shared operational area GBB as is customary, for example, with streetcars. Other traffic participants, which are not shown in FIG. 1, can cross the track GL in this shared operational area GBB or travel in the region thereof (pedestrians, cyclists, motor vehicles).

The track GL can have line-side equipment, such as a balise BL and a further line element IMU, which is formed by an inductive electrical loop. The line element IMU is embedded in the ground carrying the track GL and is not illustrated in greater detail. Furthermore, control members W1, W2 in the form of switches are represented. These determine the path of the rail vehicle FZ in the traffic network. The control members W1, W2 are actuated by controllers CL1, CL2, which implement appropriate control commands.

In the case of the first control member W1, a control command is relayed by the line element IMU to the first controller CL1 via a third interface S3, which controller implements the control command via a thirteenth interface S13 in order to set the first control member W1. In the case of the second control member W2, a control command is initiated, for example via a tenth interface S10, with the tenth interface S10 being a radio interface between two antennas AT, in the rail vehicle FZ and in a V2X unit V2X-U respectively, which is therefore designed as a V2X interface.

The processing unit CV forms part of a modified line element, which is to replace a specific line element. The specific line element is therefore not represented because it has been removed from the line or at least disabled (cf. also the explanations below in this regard). The processing unit CV converts the signal transmitted by the V2X unit V2X-U via a fourteenth interface S14 and sends it to the second controller CL2 via a fourth interface S4. The signal converted by the processing unit CV is available in the same format as the signal generated by the specific line element IMU and transmitted to the first controller CL1 via the third interface S3. For this purpose, the second controller CL2 can issue a control command to the second control member W2 via a twelfth interface S12.

FIG. 1 makes it clear that the line element IMU transmits a signal via the third interface S3 as a function of the crossing of the rail vehicle FZ. In this regard the line element IMU is configured as a sensor for detecting the crossing of rail vehicles FZ. This line element can, however, as is shown for the control member W2, be replaced by way of the processing unit CV and the V2X unit V2X-U located on the line by an antenna AT, and this enables a direct emission of a signal from the V2X unit via the fourteenth interface S14. An IT infrastructure according to the V3X-standard is used here, which is at least partially present in the traffic network anyway and which can be inexpensively retrofitted in the rail vehicle with COTS components.

A network is formed in the traffic network by a large number of antennas AT, which network enables communication. A control center LZ is also involved in which, for example, adaptive train plans can be drawn up and which collaborates in the execution of a CBTC method in the reserved operational area RBB. For this purpose, the control center LZ communicates in the tunnel TL via a first interface S1 with a signal box STW, which for its part communicates with a CBTC unit CBTC-U via a second interface S2 in order to carry out a CBTC method. A balise in the tunnel is a so-called fixed-data balise which is involved in the context of carrying out the CBTC method.

The rail vehicle FZ communicates with the control center LZ via a sixth interface S6. Further interfaces can be provided even if this is not represented in FIG. 1. For example, the rail vehicle FZ communicates with antennas AT in the tunnel TL via interfaces (not shown), so a connection can be established to the CBTC unit CBTC-U via the interface S5. It is important, however, that train protection operation in the tunnel TL via CBTC, and running on sight operation, in which a vehicle driver (not represented) drives the rail vehicle FZ, a service with a modified range of functions, compared to automatic train control operation, is used, with automatic handling and monitoring of the rail vehicle being carried out. This service is employed for communication of the V2X standard.

Figure 2:
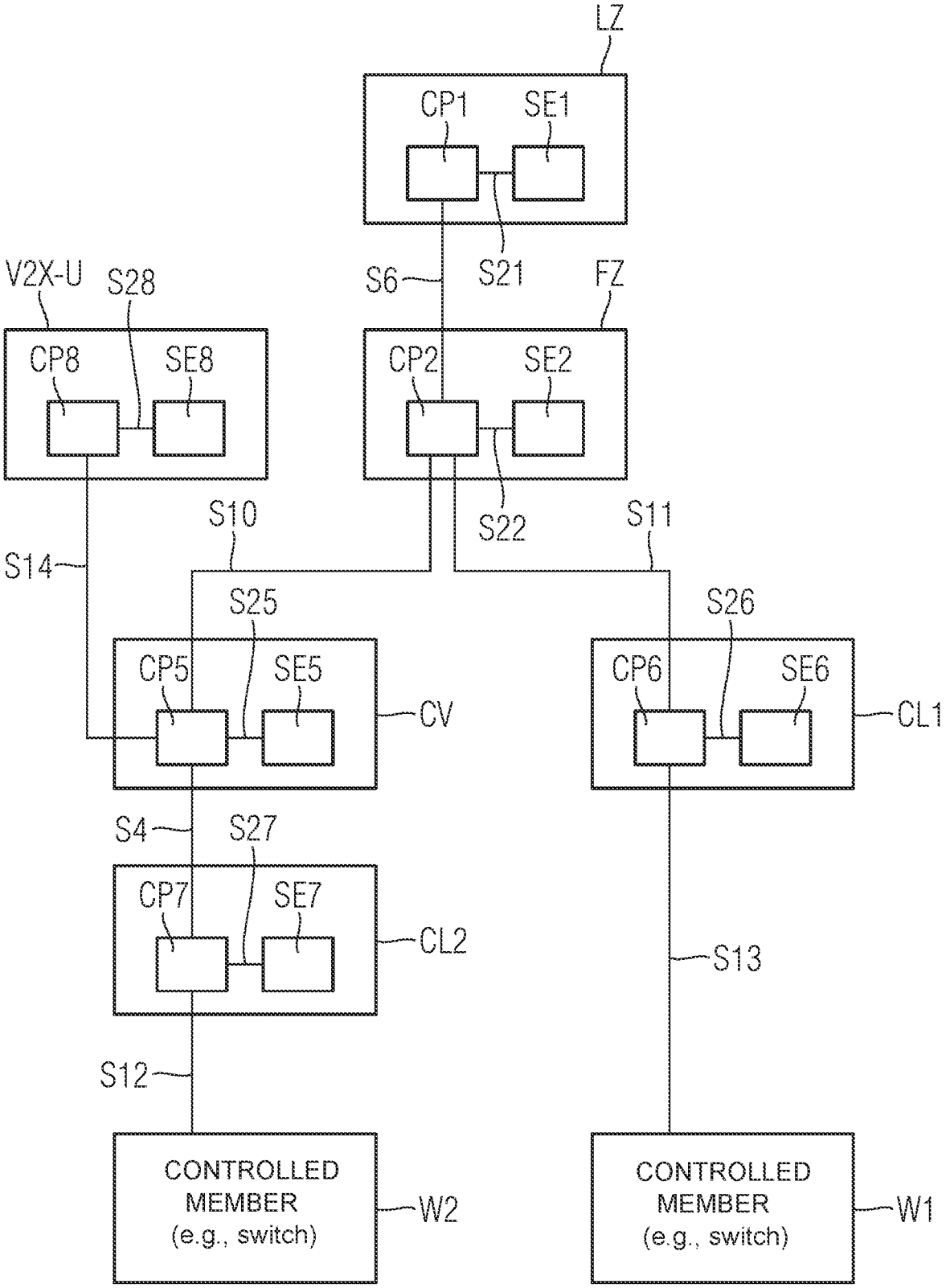
FIG. 2 shows an exemplary embodiment of a computer infrastructure of the apparatus in FIG. 1 as a block diagram, with the individual functional units executing program modules, which can run in one or more processors respectively and with it accordingly being possible for the interfaces to be designed in terms of software or hardware.

In FIG. 2 it can be seen how a network can be constructed in accordance with the representation in FIG. 1 for the shared operational area (GBB). The control center LZ has a first computer CP1 with a first storage unit SE1, which is connected to the first computer CP1 by a twenty-first interface S21. The computer CP1 of the control center LZ communicates with a computer CP2 in the rail vehicle FZ via the sixth interface S6. Details on the transmission technology are not represented in FIG. 2. For the purpose of communication the rail vehicle FZ has the second computer CP2, which is connected to a second storage unit SE2 via a twenty-second interface S22. The second computer CP2 communicates via the tenth interface S10 with a fifth computer CP5 in the processing unit CV, which likewise has a fifth storage unit SES, which is connected to the fifth computer CP5 via a twenty-fifth interface S25.

In addition, a V2X unit V2X-U is provided, which has an eighth computer CP8, which is connected to an eighth storage unit SE8 via a twenty-eighth interface S28. The fifth computer CP5 can also receive signals from the V2X unit via a fourteenth interface S14, for example via WLAN, with the relevant V2X unit being a unit provided in the shared operational area (GBB) for other traffic participants (for example motor vehicles) too.

The fifth computer CP5 communicates with a seventh computer CP7 of the second controller CL2 via the fourth interface S4, with the seventh computer CP7 being connected to a seventh storage unit SE7 via a twenty-seventh interface S27. The second controller CL2 can actuate the second control member W2 with the seventh computer CP7 via the twelfth interface S12.

Communication of the rail vehicle FZ with a sixth computer CP6 of the first controller CL1 also takes place via the eleventh interface S11. This consists in crossing over the line element IMU, with a signal then being inductively triggered. The first controller CL1 also has a sixth storage unit SE6, which is connected to the sixth computer CP6 via a twenty-sixth interface S26. The sixth computer CP6 can for its part actuate the first control member W1 via the thirteenth interface S13.

The following is a summary list of reference numerals and the corresponding structure used in the above description of the invention:

LZ control center
FZ vehicle
FR direction of travel
GL track
AT antenna
STA line section
W1 . . . W2 control member (switch)
CL1 . . . CL2 controller (controller)
CV processing unit (converter as part of the modified line element)
BL balise
TL tunnel
RBB reserved operational area
GBB shared operational area
IMU line element (specific)
STW signal box
CBTC-U CBTC unit
V2X-U V2X unit
CP1 . . . CP7 computer
SE1 . . . SE7 storage facility
S1 . . . S13 interface
ZSB train protection operation
SFB running on sight operation
SIL1 . . . 4 safe operating mode
NSIL unsafe operating mode
CBTC train running control step
TRF transfer step
INF information step
INF_OT output step for information
STB control command
STB_OT output step for control command
HMB manual command by train driver
HMB_IN input step for manual command

The invention claimed is:

1. A method for operating a rail vehicle (FZ) in a traffic network, the method comprising:

providing a shared operational area that is shared with traffic participants other than rail vehicles, wherein the rail vehicle is configured to run on sight without automatic train protection;

providing a reserved operational area reserved for rail vehicles, wherein the rail vehicle is configured to operate according to a central rail monitoring and operational management having an automatic train protection;

communicating between the rail vehicle and line elements arranged in the shared operational area by using a V2X standard for communication in the shared operational area shared with traffic participants other than rail vehicles; and communicating between the rail vehicle and line elements arranged in an operational area reserved for rail vehicles by using a communication standard different from the V2X standard for communication.

2. The method according to claim 1, which comprises using a Cooperative Awareness Message of the V2X standard for communication.

3. The method according to claim 1, wherein the line elements, which use the V2X standard, are modified to use a processing unit, which converts a message received according to the V2X standard into converted control commands for a control member or generates control commands from the received message and in both cases transmits the control commands to a controller for the respective control member, and wherein the controller actuates the control member using the control commands.

4. The method according to claim 3, wherein the converted control commands have a syntax which matches a syntax of specific line elements developed for the relevant control member.

5. The method according to claim 4, which comprises using the modified line elements and the specific line elements in the shared operational area.

6. The method according to claim 1, which comprises replacing specific line elements that are permanently fitted in a track body of the traffic network.

7. The method according to claim 6, which comprises replacing specific line elements that are embedded in a road surface surrounding the line.

8. The method according to claim 6, which comprises using modified line elements fitted outside of the track body.

9. A traffic network for operating rail vehicles, the traffic network having an operational area shared with traffic participants other than the rail vehicles, the traffic network comprising: line elements configured to carry out the method according to claim 1.

10. A rail vehicle for operation in a traffic network having an operational area shared with traffic participants other than the rail vehicle, the rail vehicle being configured to carry out the method according to claim 1 for communicating with a line element of the traffic network.

11. The rail vehicle according to claim 10, wherein the line element is a modified line element.

12. A processing unit for operation in a traffic network having an operational area shared between traffic participants that include rail vehicles and traffic participants other than the rail vehicles, the processing unit being configured to carry out a method according to claim 1 to process signals in a line element.

13. A computer program comprising non-transitory program commands for carrying out the method according to claim 1 when the program commands are executed on a computer.

14. An apparatus for providing the computer program according to claim 13, wherein the apparatus is configured for storing and/or providing the computer program.

15. A method of modernizing an operational area for rail vehicles, wherein the operational area has control members, which are actuated by line elements using control commands, the method comprising:

for modernizing the operational area, successively replacing line elements specific to the relevant control member and fitted in a line of the operational area with modified line elements;

configuring a processing unit of the modified line elements, the processing unit converting a message received in accordance with one communication standard into modified control commands for a control member or generating control commands from the message and in both cases transmitting the control commands to a controller for the respective control member, and actuating the control member with the control commands;

the control commands having a syntax, which matches a syntax of specific line elements fitted in the line for the rail vehicle; and using the modified line elements having a processing unit and specific line elements in the shared operational area.

16. The method according to claim 15, which comprises using a V2X standard as the communication standard.

17. The method according to claim 15, wherein the operational area lies in a traffic network which is shared with traffic participants other than the rail vehicles.

* * * * *